US012031416B2

(12) United States Patent
Tafur et al.

(10) Patent No.: US 12,031,416 B2
(45) Date of Patent: Jul. 9, 2024

(54) FLOW CONTROL MODULE FOR SAND CONTROL MANAGEMENT

(71) Applicant: Schlumberger Technology Corporation, Sugar Land, TX (US)

(72) Inventors: Maria Tafur, Houston, TX (US); Ganesh Balasubramanian, Sugar Land, TX (US); Amrendra Kumar, Missouri City, TX (US); Raghuram Kamath, Richmond, TX (US); Benoit Deville, Houston, TX (US); Michael Dean Langlais, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/247,548

(22) PCT Filed: Oct. 5, 2021

(86) PCT No.: PCT/US2021/053513
§ 371 (c)(1),
(2) Date: Mar. 31, 2023

(87) PCT Pub. No.: WO2022/076370
PCT Pub. Date: Apr. 14, 2022

(65) Prior Publication Data

US 2024/0011371 A1 Jan. 11, 2024

Related U.S. Application Data

(60) Provisional application No. 63/087,955, filed on Oct. 6, 2020.

(51) Int. Cl.

| | |
|---|---|
| ***E21B 43/04*** | (2006.01) |
| ***E21B 43/08*** | (2006.01) |
| ***E21B 43/14*** | (2006.01) |

(52) U.S. Cl.
CPC ..... *E21B 43/04* (2013.01); *E21B 43/082* (2013.01); *E21B 43/14* (2013.01)

(58) Field of Classification Search
CPC ..... E21B 43/08; E21B 43/12; E21B 43/04; E21B 34/14; E21B 43/086; E21B 43/082; E21B 43/10; E21B 43/14
See application file for complete search history.

(56) References Cited

U.S. PATENT DOCUMENTS

| | | | |
|---|---|---|---|
| 7,857,061 | B2 | 12/2010 | Richards |
| 7,984,760 | B2 | 7/2011 | Haeberle |

(Continued)

FOREIGN PATENT DOCUMENTS

| | | | | |
|---|---|---|---|---|
| WO | 03080993 | A1 | 10/2003 | |
| WO | 2017058255 | A1 | 4/2017 | |
| WO | WO-2019246009 | A1 * | 12/2019 | ..... E21B 33/12 |

OTHER PUBLICATIONS

Intenational Search Report and Written Opinion issued in the PCT Application PCT/US2021/053513, dated Jan. 10, 2022 (13 pages).

*Primary Examiner* — Zakiya W Bates
(74) *Attorney, Agent, or Firm* — Jeffrey D. Frantz

(57) ABSTRACT

A tool includes a mandrel and at least one gate. The mandrel includes a bore, and the mandrel is able to connect in-line with at least one sand control device of a bottom hole assembly such that the mandrel is coaxial with the at least one sand control device. The mandrel also includes a flow path configuration, such as, at least one flow path connecting the at least one sand control device to the bore, at least one flow path connecting the bore to at least two sand control devices, and at least one flow path connecting the bore to the at least one sand control device and to another device of the bottom hole assembly. The at least one gate has an initial (Continued)

position, and the at least one gate is configured to move from the initial position into a different position to control fluid flow.

20 Claims, 10 Drawing Sheets

(56) References Cited

U.S. PATENT DOCUMENTS

| | | | |
|---|---|---|---|
| 8,074,719 | B2 | 12/2011 | Richards |
| 8,127,831 | B2 | 3/2012 | Haeberle |
| 10,100,606 | B2 | 10/2018 | Langlais |
| 2007/0246213 | A1 | 10/2007 | Hailey |
| 2009/0008092 | A1 | 1/2009 | Haeberle et al. |
| 2013/0248178 | A1 | 9/2013 | Hecker |
| 2015/0308238 | A1 | 10/2015 | Langlais |

* cited by examiner

12
Actuator
40a
34
20
42
46
Wiring/Conduit/
Control Line
20
44
18
20
41
16
40b

Mechanical Actuator (Spring)
Lock
34
43
20
18
Hydrostatic
41
16

Mechanical Actuator (Spring)
Lock
34
43
20
18
Hydrostatic
41
16

FLOW CONTROL MODULE FOR SAND CONTROL MANAGEMENT

CROSS-REFERENCE TO RELATED APPLICATIONS

The present application is a National Stage of International Application No. PCT/US2021/053513, filed Oct. 5, 2021, which claims priority benefit of U.S. Provisional Application No. 63/087,955, filed Oct. 6, 2020, the entirety of which is incorporated by reference herein and should be considered part of this specification.

BACKGROUND

Gravel packs are used in wells for removing particulates from inflowing hydrocarbon fluids. In a variety of applications, gravel packing is performed in long horizontal wells by pumping gravel suspended in a carrier fluid down the annulus between the wellbore and a screen assembly. The carrier fluid is returned to the surface after depositing the gravel in the wellbore annulus. To return to the surface, the carrier fluid flows through the screen assembly, through base pipe perforations, and into a production tubing, which routes the returning carrier fluid back to the surface. Additionally, some applications utilize alternate path systems having various types of shunt tubes, which help distribute the gravel slurry. In some applications, inflow control devices have been combined with screen assemblies to provide control over the subsequent inflow of production fluids.

More specifically, an APS-ICD (Alternate Path System-Inflow Control Device) downhole completions tool is a screened joint that may be used for (1) gravel packing, and (2) intelligent flow control of formation fluids. When the APS-ICD tool is in gravel packing mode, the surrounding annulus is packed with gravel that is pumped via a carrier fluid from surface. In the tool, the gravel flows through shunt tubes and nozzles to create an alternate flow path that bypasses sand bridges and fills in voids that may occur during the gravel pumping. To achieve intelligent production of formation fluids, the gravel is dehydrated through the screened joint into drainage ports in the tool.

After the annulus is packed, the APS-ICD tool transitions from gravel packing mode to intelligent production mode. During production mode, formation fluids are directed through inflow control devices, which regulate the flow rates across the completed zones in the well. A system and method is necessary to facilitate a successful transition from gravel packing mode to intelligent production mode.

SUMMARY

According to one or more embodiments of the present disclosure, a tool includes a mandrel including a bore; means for connecting the mandrel in-line with at least one sand control device of a bottom hole assembly such that the mandrel is coaxial with the at least one sand control device; and a flow path configuration selected from at least one of the group consisting of: at least one flow path connecting the at least one sand control device to the bore; at least one flow path connecting the bore to at least two sand control devices; and at least one flow path connecting the bore to the at least one sand control device and to another device of the bottom hole assembly; and at least one gate having an initial position, the at least one gate being configured to move from the initial position into a different position to control fluid flow.

According to one or more embodiments of the present disclosure, a method includes conveying a bottom hole assembly downhole in a wellbore, the bottom hole assembly including: at least one sand control device; and a tool including: a mandrel including: a bore; means for connecting the mandrel in-line with the at least one sand control device such that the mandrel is coaxial with the at least one sand control device; and a flow path configuration selected from at least one of the group consisting of: at least one flow path connecting the at least one sand control device to the bore; at least one flow path connecting the bore to at least two sand control devices; and at least one flow path connecting the bore to the at least one sand control device and to another device of the bottom hole assembly; and at least one gate having an initial position; performing a gravel packing operation through the at least one sand control device and the tool while the at least one gate is in the initial position; after the gravel packing operation, actuating the at least one gate of the tool from the initial position into a different position to control production fluid flow; and performing a production operation through the at least one sand control device and the tool while the at least one gate is in the different position.

A system according to one or more embodiments of the present disclosure includes a bottom hole assembly including: a plurality of sand control devices, wherein at least one sand control device of the plurality of sand control devices is coupled with a tool, the tool including: a mandrel including: a bore; and means for connecting the mandrel in-line with a corresponding sand control device of the plurality of sand control devices such that the mandrel is coaxial with the corresponding sand control device; and a flow path configuration selected from the group consisting of: at least one flow path connecting the at least one sand control device to the bore; at least one flow path connecting the bore to at least two sand control devices; and at least one flow path connecting the bore to the at least one sand control device and to another device of the bottom hole assembly; and at least one gate having an initial position for a gravel packing operation, the at least one gate being configured to move from the initial position into a different position for a production operation to control fluid flow.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure.

Figure 1:
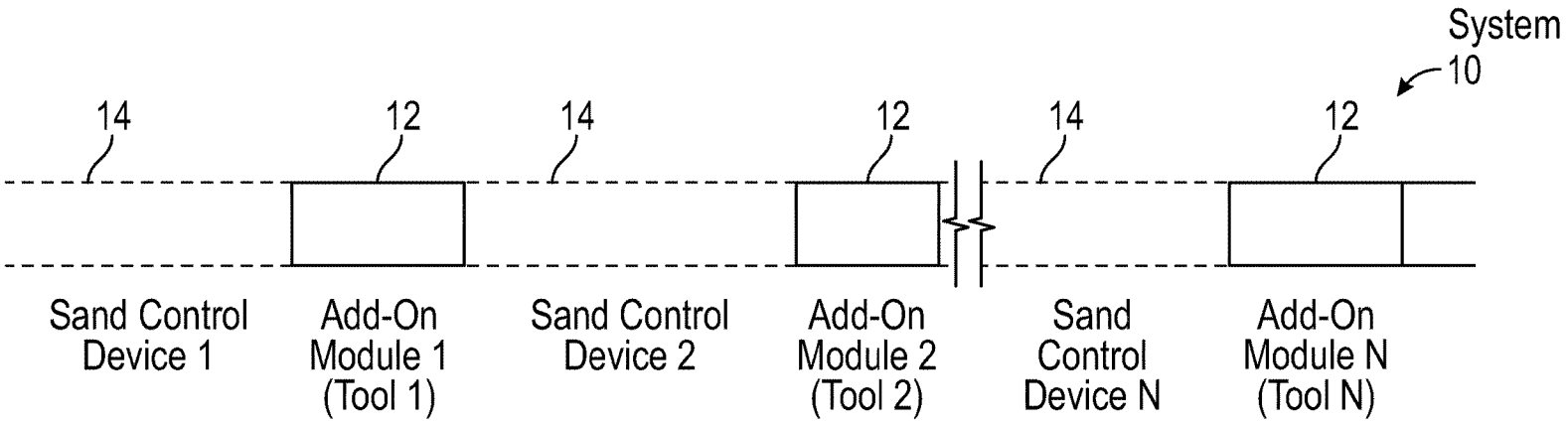
FIG. 1 shows a schematic view of a hybrid APS-ICD system having an add-on module associated with each sand control device, according to one or more embodiments of the present disclosure.

The present disclosure generally relates to a tool, method, and system for facilitating a change in configuration or mode of a downhole completions tool. More specifically, the present disclosure relates to a tool, method, and system for facilitating a change of a hybrid APS-ICD system from a gravel packing mode to an intelligent production mode. Gravel packing operations require a large flow area to allow dehydration and carrier fluid flow back to the surface, which in turn, enables gravel transport and deposition. Intelligent production operations require a minimal and tailored flow surface area, which creates a specific pressure drop, thus preventing disproportionate hydrocarbon production from formation zones having varying permeability. Because gravel packing and intelligent production operation requirements are in opposition, there is a need to reduce the flow area in a sand screen system as the system transitions from gravel packing mode to intelligent production mode. The tool, system, and method according to one or more embodiments of the present disclosure includes a module added onto an APS sand control device to facilitate the transition between gravel packing mode and intelligent production mode. For example, FIG. 1 shows a schematic view of a hybrid APS-ICD system 10 as part of a bottom hole assembly (BHA) having a module, i.e., an add-on module 12, added onto each sand control device 14 of the system 10, according to one or more embodiments of the present disclosure. Advantageously, the APS-ICD system 10 with add-on modules 12 does not necessarily require an activation joint or a control line for operation in one or more embodiments of the present disclosure.

Figure 2:
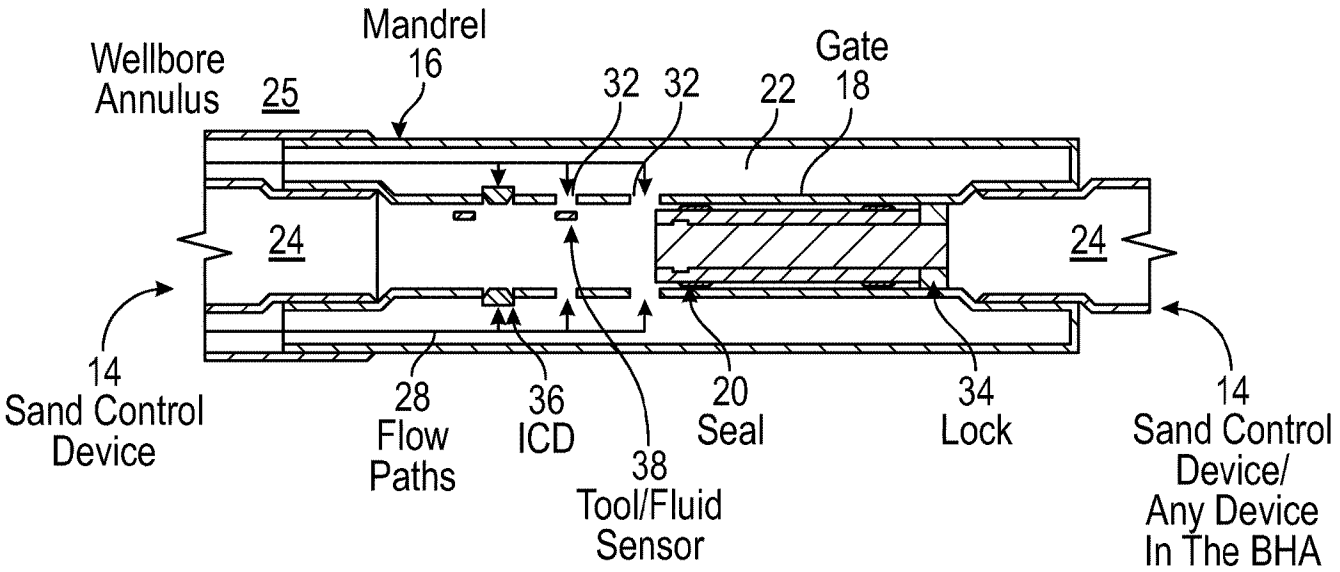
FIG. 2 shows a zoomed-in cross-sectional view of an add-on module in a first configuration according to one or more embodiments of the present disclosure.

Referring now to FIG. 2, a zoomed-in cross-sectional view of an add-on module 12 in a first configuration according to one or more embodiments of the present disclosure is shown. For context, the add-on module 12 is shown added onto a sand control device 14. In one or more embodiments of the present disclosure, the add-on module 12 may be connected to a sand control device 14 at both ends such that the add-one module 12 is installed between two sand control devices 14, or the add-on module 12 may be added onto a sand control device 14 at one end, and may be connected to any other device in the BHA at the other end.

Still referring to FIG. 2, the add-on module 12 according to one or more embodiments of the present disclosure includes a mandrel 16. The mandrel 16 according to one or more embodiments of the present disclosure may assume any cross-sectional shape, such as circular or non-circular, for example. In one or more embodiments of the present disclosure, the mandrel 16 includes a bore 22, as shown in FIG. 2, for example. In one or more embodiments of the present disclosure, the downhole tubular 24 may be an inner diameter of the tool, including a base pipe of a coupled sand control device 14, or any other device in the BHA, for example. Further, the mandrel 16 may include means for connecting 26 the mandrel 16 in-line with the sand control device 14 (or any other device in the BHA) such that, when connected, the mandrel 16 is coaxial with the sand control device 14 (or other BHA device). According to one or more embodiments of the present disclosure, the means for connecting 26 the mandrel 16 in-line with the sand control device 14 (or other BHA device) may include, threading, retaining elements, other mechanical engagement, or other equivalents thereof, for example. With the mandrel 16 of the add-on module 12 connected to the sand control device 14 (or other BHA device) in this way, the mandrel 16 may have at least one flow path 28 connecting the sand control device 14 to the bore 22 of the mandrel 16, at least one flow path 28 connecting the bore 22 of the mandrel 16 to at least two sand control devices 14 (FIG. 3A), or at least one flow path 28 connecting the bore 22 of the mandrel 16 to the sand control device 14 and to any other device in the BHA (FIG. 2). In one or more embodiments of the present disclosure, the flow paths 28 in the mandrel 16 may be axial or radial to a downhole tubular 24, or any combination of these. According to one or more embodiments of the present disclosure, the downhole tubular 24, which may be a base pipe of a coupled sand control device 14 or any other device in the BHA, for example, may be connected to the bore 22 of the mandrel 16. As shown in FIG. 2, for example, the inside of the downhole tubular 24 may be coaxial with the at least one sand control device 14 or other device in the BHA. Moreover, the mandrel 16 may include sealing mechanisms 20 to channel fluid through different flow paths 28 in the add-on module 12. According to one or more embodiments of the present disclosure, these sealing mechanisms 20 may allow pressure containment.

Figure 3A:
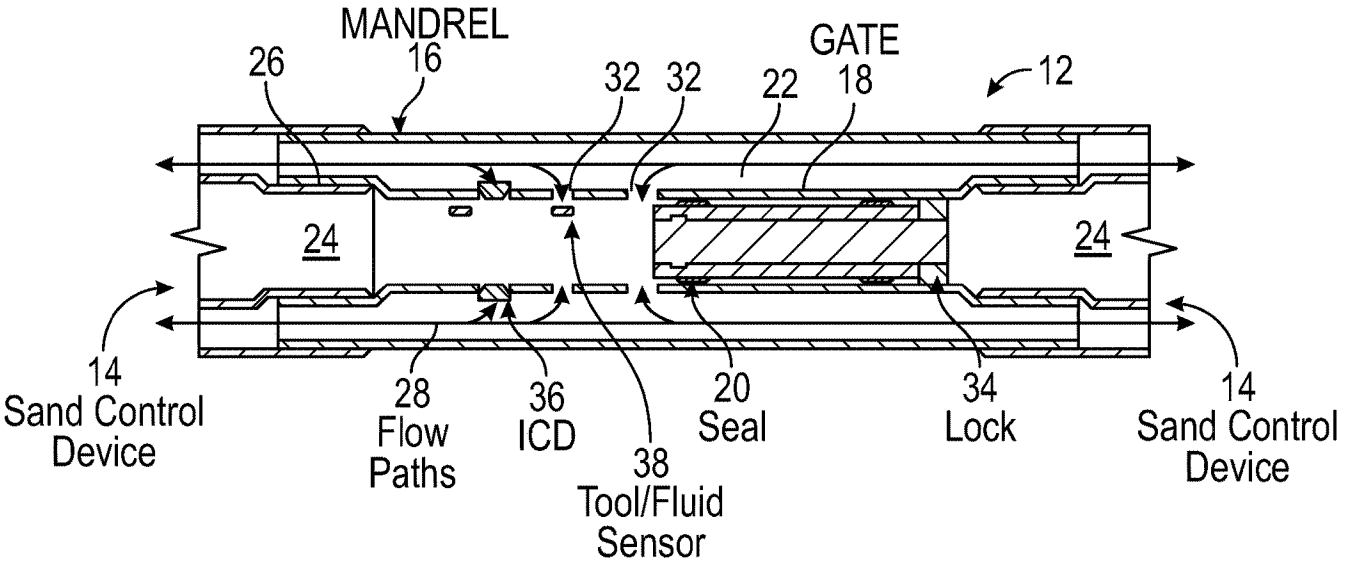
FIG. 3A shows an add-on module in a second configuration according to one or more embodiments of the present disclosure.
Figure 3B:
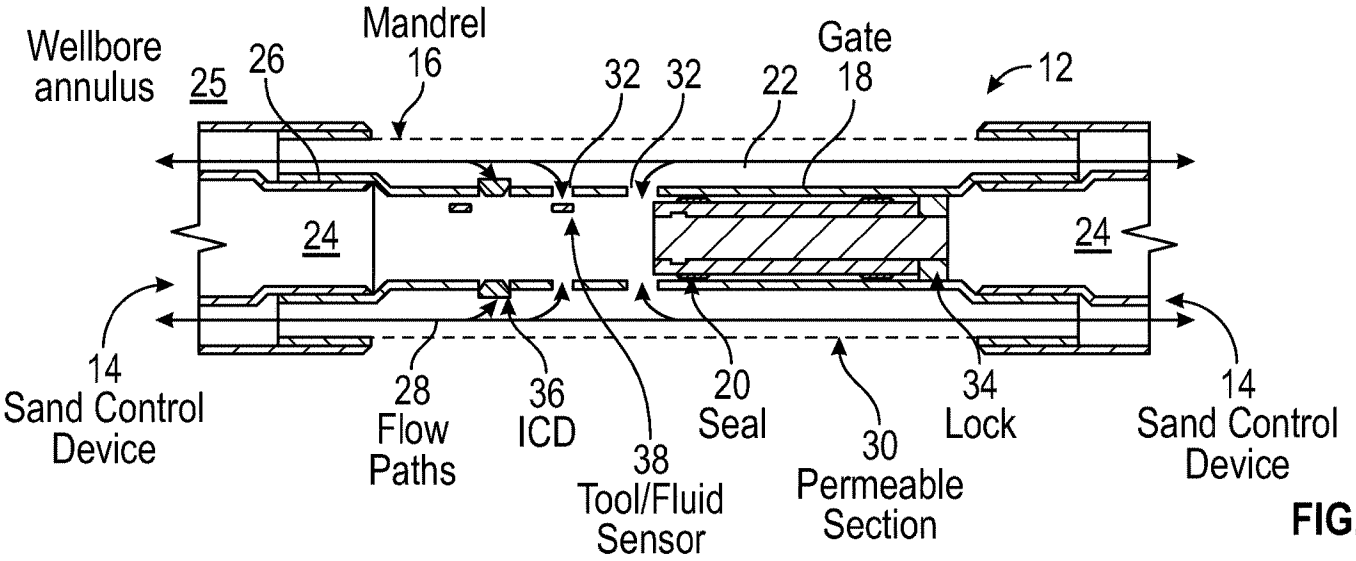
FIG. 3B shows the add-on module in the second configuration with an outer permeable section according to one or more embodiments of the present disclosure.

Referring now to FIG. 3B, the mandrel 16 may include an outer permeable section 30 that filters fluid from the wellbore annulus 25 into the add-on module 12 in one or more embodiments of the present disclosure. As further shown in FIGS. 2, 3A, and 3B, the mandrel 16 may have an inner permeable section 32 that filters fluid from the inside of the downhole tubular 24 into the add-on module 12. That is, the mandrel 16 according to one or more embodiments of the present disclosure may have lateral permeable sections for filtering fluid from devices coupled in-line into the add-on module 12. According to one or more embodiments of the present disclosure, the mandrel 16 of the add-on module 12 may be a one-piece part or a multiple-piece assembly.

In addition to the mandrel 16, the add-on module 12 according to one or more embodiments of the present disclosure may include at least one gate 18, as shown in FIGS. 2, 3A, and 3B for example. In one or more embodiments of the present disclosure, the at least one gate 18 may assume any cross-sectional shape, such as circular or non-circular, for example. According to one or more embodiments of the present disclosure, the at least one gate 18 may include at least one sealing mechanism 20 to channel the fluid through the different flow paths 28 in the add-on module 12. The at least one sealing mechanism 20 of the at least one gate 18 may allow pressure containment within the add-on module 12 according to one or more embodiments of the present disclosure. Further, the at least one sealing mechanism 20 may be active (i.e., swelling controlled by a user) or passive, in one or more embodiments of the present disclosure.

Still referring to FIGS. 2, 3A, and 3B, the at least one gate 18 of the add-on module 12 may be outside, inside, or running through the mandrel 16 according to one or more embodiments of the present disclosure. As further described below, the at least one gate 18 may be actuated to move from an initial position to a new, different position to control fluid flow according to one or more embodiments of the present disclosure. The at least one gate 18 according to one or more embodiments of the present disclosure may be maintained in at least one of the initial position and each new, different position by at least one locking mechanism 34, which may include a pressure differential, electromagnetic coupling, chemical reactions (including dissolvable elements), friction, mechanical engagement, retaining elements, shear elements, or any combination thereof, for example. In one or more embodiments of the present disclosure, the at least one gate 18 may be a one-piece part or a multiple-piece assembly, for example. Further, the at least one gate 18 may include a combination of gates, a combination of pistons, or any combination thereof without departing from the scope of the present disclosure.

According to one or more embodiments of the present disclosure, the at least one gate 18 is operable by an actuator (not shown in FIG. 2, 3A or 3B, but further described below). In one or more embodiments of the present disclosure, the actuator may be disposed inside the add-on module 12. Moreover, the actuator may be outside the add-on module 12 or running through the BHA, the actuator being disposed on or in one or more of a service tool, a washpipe, a pipe, a wire, a conduit, fluids, or a device carried by fluids, for example, according to one or more embodiments of the present disclosure. Types of actuators contemplated by the scope of the present disclosure for operating the at least one gate 18 include, for example, pressure stimuli (e.g., pressure differential and/or signal), electromagnetic stimuli (e.g., fiber optics, RFID, or magnetic locators, such as casing collar locators), mechanical stimuli (e.g., vibration and acoustics), chemical stimuli and chemical reactions (e.g., radioactives), friction, mechanical engagement and/or disengagement, and any combination thereof. According to one or more embodiments of the present disclosure, the actuator may be passive, active, or a combination of these. In one or more embodiments of the present disclosure, the actuator may include its own power source on board, or the actuator may be connected to external power sources in the wellbore and its fluids, in the BHA, and/or at surface. According to one or more embodiments of the present disclosure, the actuator may be a one-piece part, or the actuator may be a multi-piece assembly.

As previously described, the actuator may actuate the at least one gate 18 to move from an initial position to a new, different position to control fluid flow according to one or more embodiments of the present disclosure. In one or more embodiments of the present disclosure, a gravel packing operation may be performed through the sand control device 14 and the add-on module 12 while the at least one gate 18 is in the initial position, and after the at least one gate 18 is actuated to move from the initial position to the new, different position, a production operation may be performed through the sand control device 14 and the add-on module 12. In one or more embodiments of the present disclosure, in the different position, the at least one gate 18 allows or restricts passage of fluid through a particular configuration of flow paths 28 within the mandrel 16. Moreover, in the different position, the at least one gate 18 may isolate at least one flow path 28 of the add-on module 12 from at least one of other devices, including other sand control devices 14, in the BHA; the wellbore annulus 25; and the inside of the downhole tubular 24, according to one or more embodiments of the present disclosure.

Still referring to FIGS. 2, 3A, and 3B, the add-on module 12 according to one or more embodiments of the present disclosure may include at least one inflow control device (ICD) 36. According to one or more embodiments of the present disclosure, an ICD 36 may be installed in the mandrel 16, the at least one gate 18, any component in the add-on module 12, or a combination of these. According to one or more embodiments of the present disclosure, the at least one ICD 36 may be installed in-line with any of the flow paths 28 in the add-on module 12, including any inlet flow paths 28, outlet flow paths 28, or any intermediate section of the flow paths 28, for example. According to one or more embodiments of the present disclosure, the at least one ICD 36 may be a one-piece part of a multiple-piece assembly, for example.

Still referring to FIGS. 2, 3A, and 3B, the add-on module 12 according to one or more embodiments of the present disclosure may include at least one monitoring mechanism 38 to record and transmit information regarding the status of the add-on module 12 and downhole fluids, for example. Regarding the status of the add-on module 12, according to one or more embodiments of the present disclosure, the at least one monitoring mechanism 38 may record and transmit information on the position of the at least one gate 18 in the mandrel 16, which may be referred to as a flow path configuration, the position of the add-on module 12 in the BHA, and the data of the add-on module 12. Regarding the status of downhole fluids, according to one or more embodiments of the present disclosure, the at least one monitoring mechanism 38 may record and transmit properties of the downhole fluids including, mechanical properties, thermodynamic properties, chemical properties, or a combination of these, for example. According to one or more embodiments of the present disclosure, monitoring by the at least one monitoring mechanism 38 includes pressure sensing (e.g., pressure differential and/or signal), electromagnetic sensing (e.g., fiber optics RFID, magnetic locators, such as casing collar locators), mechanical sensing (e.g., vibration and acoustics), chemicals and chemical reactions sensing (e.g., radioactivity), and any combination thereof.

Still referring to FIGS. 2, 3A, and 3B, the at least one monitoring mechanism 38 according to one or more embodiments of the present disclosure may be installed in-line with any of the flow paths 28 in the add-on module 12, including any inlet flow paths 28, outlet flow paths 28, or any intermediate section of the flow paths 28, for example. According to one or more embodiments of the present disclosure, the at least one monitoring mechanism 38 may be installed outside the add-on module 12 or running through the BHA, the at least one monitoring mechanism 38 being disposed on or in a service tool (fixed and/or non-fixed to an apparatus at surface), a washpipe, a pipe, a wire, a conduit, fluids, or a device carried by fluids, or any combination of these, for example. According to one or more embodiments of the present disclosure, the at least one monitoring mechanism 38 may be passive, active, or a combination of these. In one or more embodiments of the present disclosure, the at least one monitoring mechanism 38 may include its own power source on board, or the at least one monitoring mechanism 38 may be connected to external power sources in the wellbore and its fluids, in the BHA, and/or at surface. According to one or more embodiments of the present disclosure, the at least one monitoring mechanism 38 may transmit downhole information to an actuator for actuating the at least one gate 18, for example. According to one or more embodiments of the present disclosure, the at least one monitoring mechanism 38 may be a one-piece part, or the at least one monitoring mechanism 38 may be a multi-piece assembly.

Figure 4:
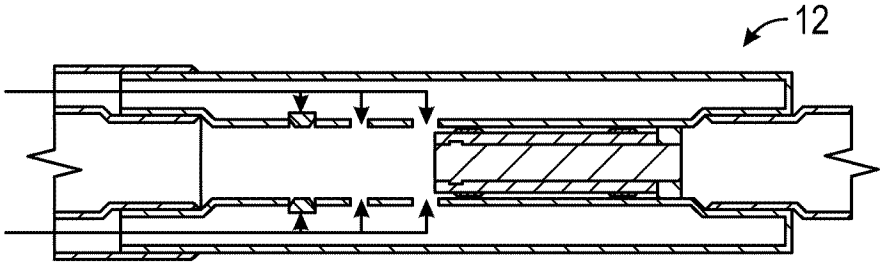
FIG. 4 shows an add-on module according to one or more embodiments of the present disclosure.
Figure 4B:
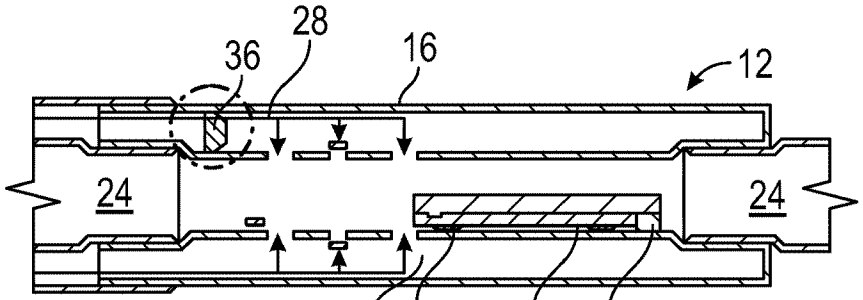
FIGS. 4A-4G show add-on modules having different ICD positions and gate configurations, according to one or more embodiments of the present disclosure.
Figure 4D:
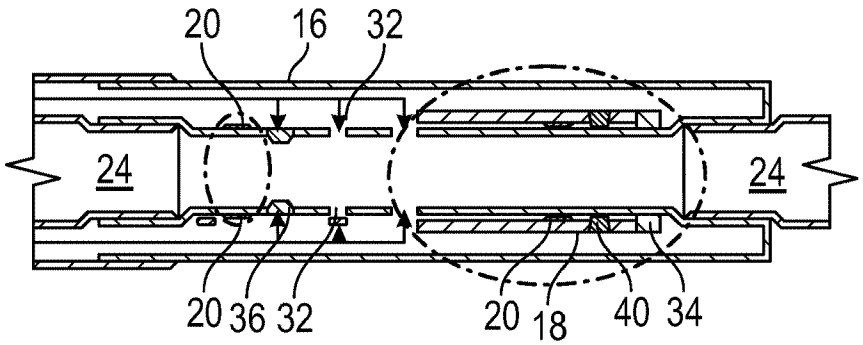
Figure 4A:
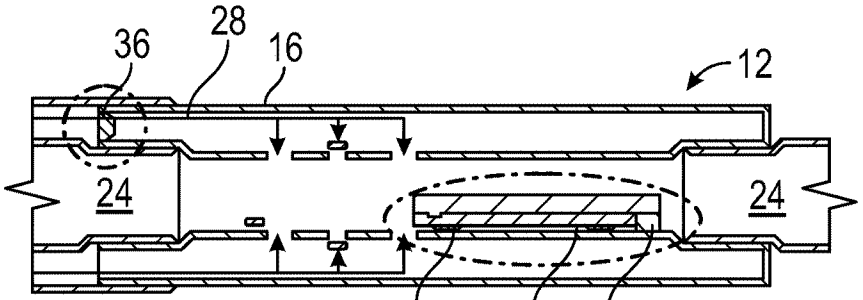

Referring now to FIG. 4, an add-on module 12 as previously described with respect to FIG. 2 is shown to provide a comparative reference for FIGS. 4A-4G, which show add-on modules 12 having different ICD 36 positions and gate 18 configurations according to one or more embodiments of the present disclosure. For example, FIG. 4A shows an add-on module 12 according to one or more embodiments of the present disclosure having an ICD 36 in the inlet of the flow path 28 from the downhole tubular 24. As further shown in FIG. 4A, the add-on module 12 according to one or more embodiments of the present disclosure may include a one-sided inner gate 18 having at least one sealing mechanism 20 and at least one locking mechanism 34.

FIG. 4B shows an add-on module 12 according to one or more embodiments of the present disclosure having an ICD 36 in the flow path 28 in the bore 22 of the mandrel 16 and a one-sided inner gate 18 having at least one sealing mechanism 20 and at least one locking mechanism 34.

Figure 4C:
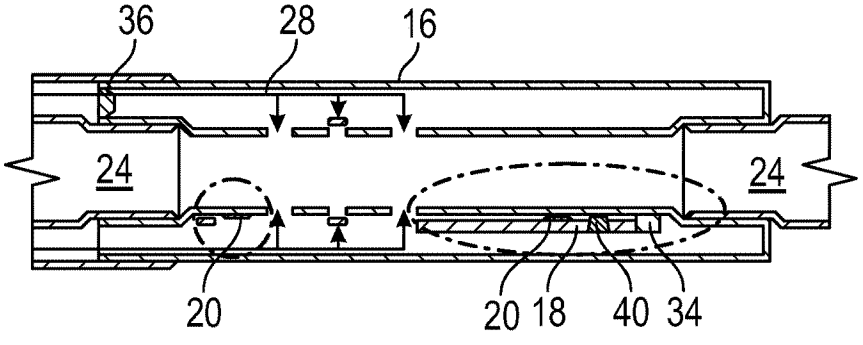

FIG. 4C shows an add-on module 12 according to one or more embodiments of the present disclosure having at least one sealing mechanism 20 on the mandrel 16, and a one-sided through-mandrel gate 18 having at least one sealing mechanism 20, at least one actuator 40, and at least one locking mechanism 34 according to one or more embodiments of the present disclosure. FIG. 4C also shows that the add-on module 12 having at least one sealing mechanism 20 on the mandrel 16 and the one-sided through-mandrel gate 18 may also include an ICD 36 in the flow path 28 in the bore 22 of the mandrel 16 in accordance with one or more embodiments of the present disclosure.

FIG. 4D shows an add-on module 12 according to one or more embodiments of the present disclosure having at least one sealing mechanism 20 on both sides of the mandrel 16 and a doubled-sided/all-around through-mandrel gate 18. FIG. 4D also shows that the add-on module 12 according to such embodiments of the present disclosure may also include an ICD 36 in the flow path 28 of the inner permeable section 32 of the mandrel 16.

Figure 4F:
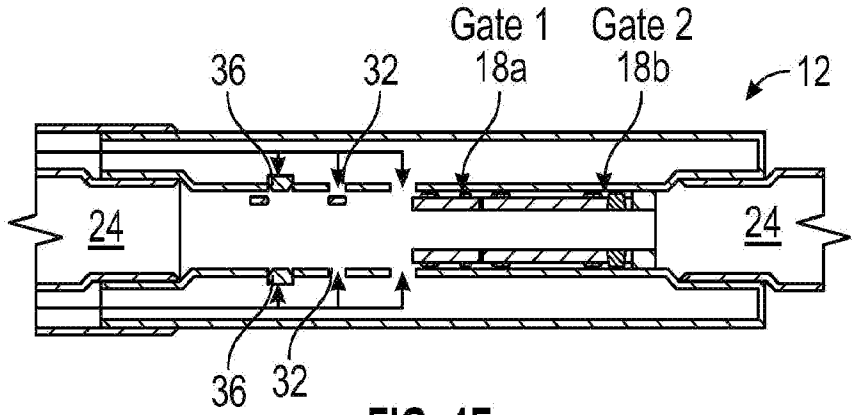
Figure 4E:
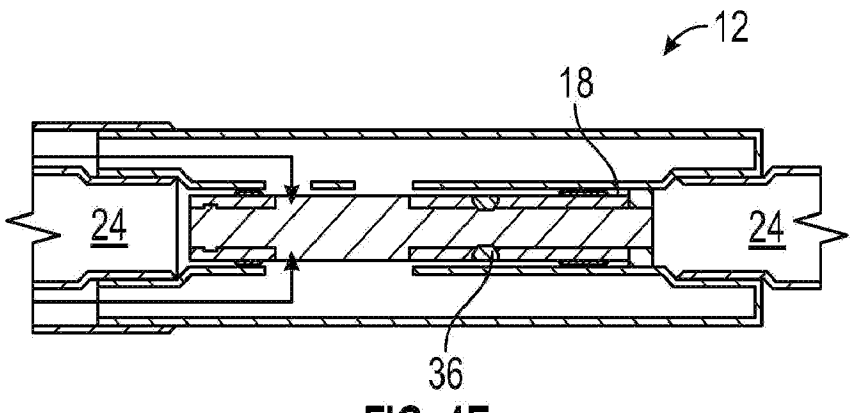

FIG. 4E shows an add-on module 12 according to one or more embodiments of the present disclosure having at least one ICD 36 disposed in a double-sided inner gate 18. As further shown in FIG. 4E, the double-sided inner gate 18 may include at least one sealing mechanism 20 and at least one locking mechanism 34 in accordance with one or more embodiments of the present disclosure.

FIG. 4F shows an add-on module 12 according to one or more embodiments of the present disclosure having a double-sided, two-part inner gate 18*a*, 18*b*. As shown in FIG. 4F, the two parts of inner gate 18*a*, 18*b* may be contiguous according to one or more embodiments of the present disclosure. FIG. 4F also shows that the add-on module 12 according to such embodiments of the present disclosure may also include at least one ICD 36 in a flow path 28 of the inner permeable section 32 of the mandrel 16.

Figure 4G:
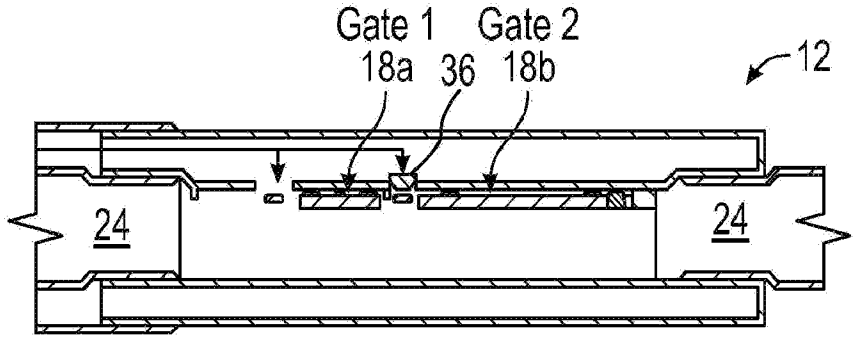

FIG. 4G shows an add-on module 12 according to one or more embodiments of the present disclosure having a one-sided, two-part inner gate 18*a*, 18*b*. As shown in FIG. 4G, the two parts of the inner gate 18*a*, 18*b* may be non-contiguous according to one or more embodiments of the present disclosure. FIG. 4G also shows that the add-on module 12 according to such embodiments of the present disclosure may also include at least one ICD 36 in a flow path 28 of the inner permeable section 32 of the mandrel 16 that flows between the non-contiguous parts of the inner gate 18*a*, 18*b*.

Figure 5A:
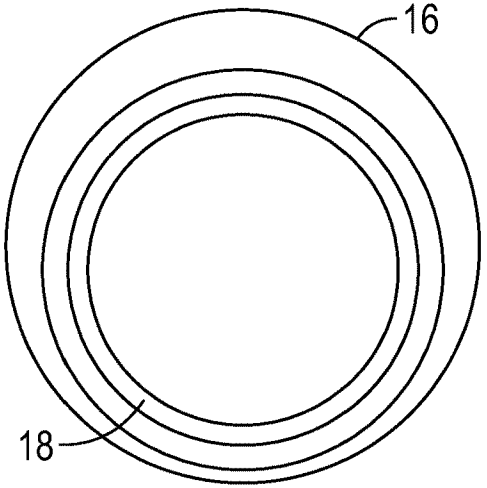
FIGS. 5A-5E show different cross-sections of the add-on module according to one or more embodiments of the present disclosure.
Figure 5B:
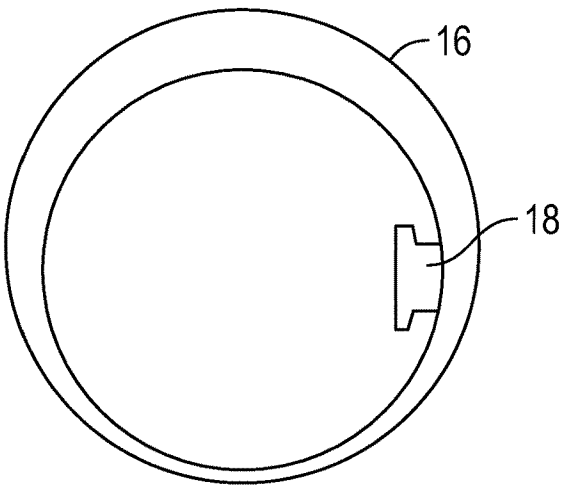
Figure 5C:
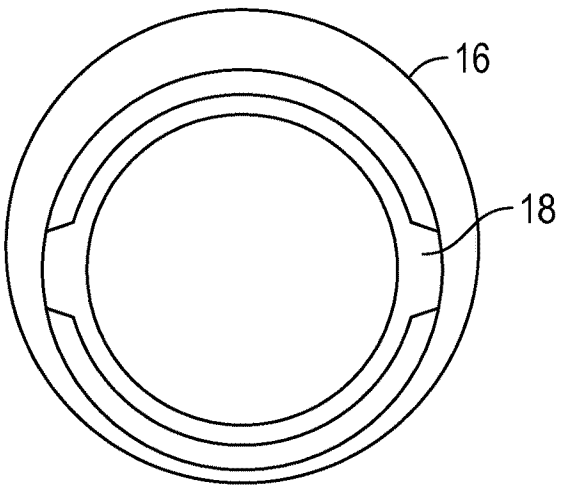
Figure 5D:
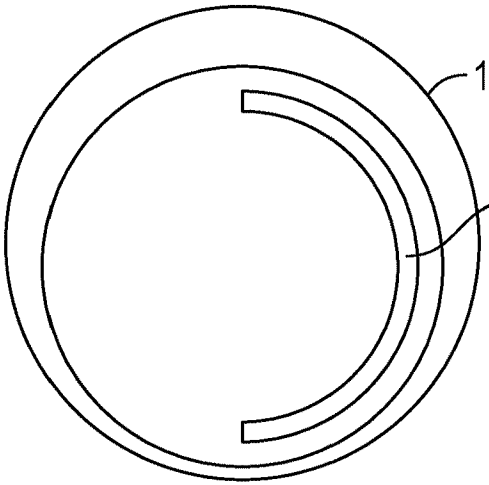
Figure 5E:
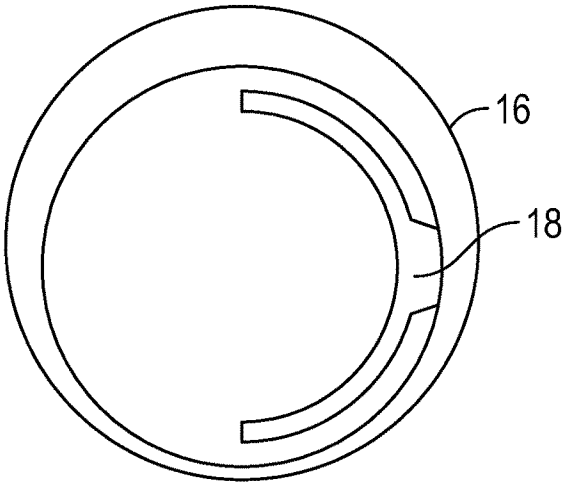

As previously described, the mandrel 16 of the add-on module 12 according to one or more embodiments of the present disclosure may assume any cross-sectional shape, such as circular or non-circular, for example. For example, FIGS. 5A-5E show different and non-limiting cross-sections of the add-on module 12 due to different gate 18 configurations according to one or more embodiments of the present disclosure. Specifically, FIG. 5A shows an annular gate 18 within a mandrel 16, FIG. 5B shows a one-side rectangular gate 18 within a mandrel 16, FIG. 5C shows a two-sided rectangular gate 18 within a mandrel 16, FIG. 5D shows a semi-annular gate 18 within a mandrel 16, and FIG. 5E shows a semi-annular rectangular gate 18 according to one or more embodiments of the present disclosure. While FIGS. 5A-5E show mandrels 16 having a circular cross-section and certain configurations of the gate 18, other cross-sections of the mandrels 16 and gate 18 configurations are contemplated and are within the scope of the present disclosure.

Figure 6B:
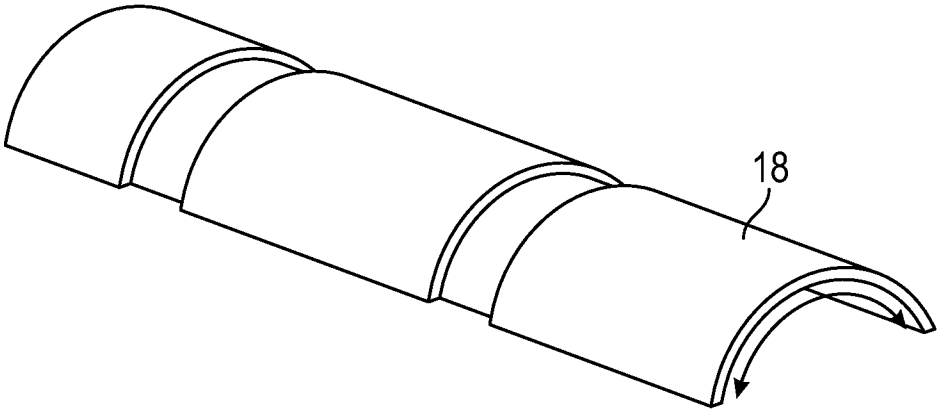
FIGS. 6A-6C show different configurations of the gate of the add-on module according to one or more embodiments of the present disclosure.
Figure 6C:
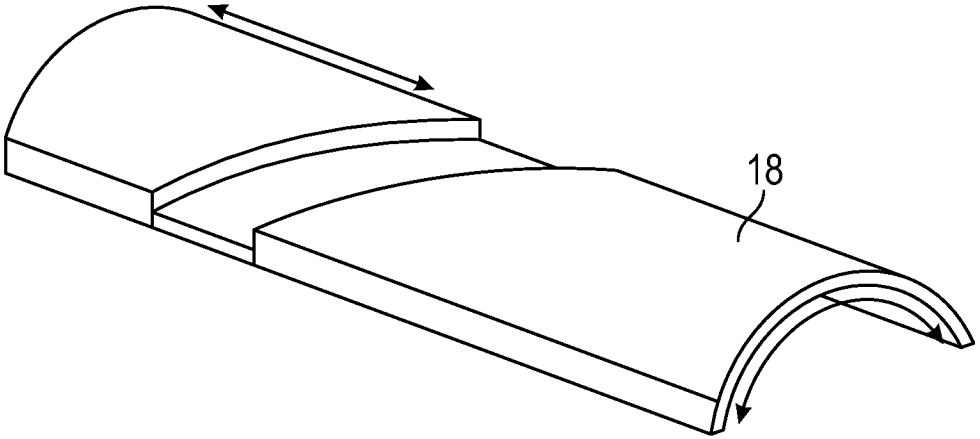
Figure 6A:
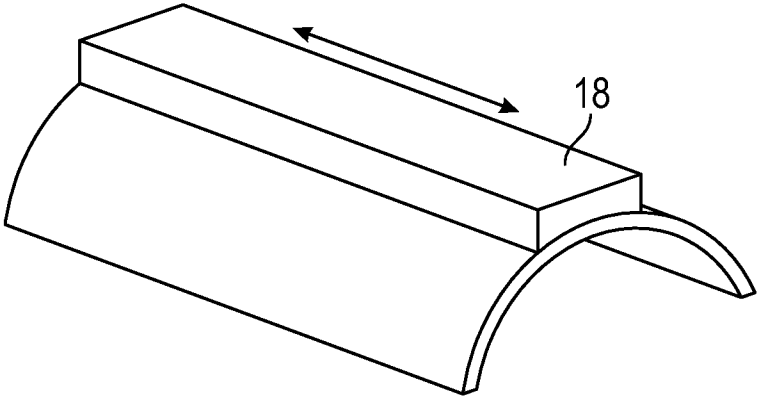

Referring now to FIGS. 6A-6C, different configurations of the gate 18 of the add-on module 12 according to one or more embodiments of the present disclosure are shown. For example, FIG. 6A shows a rectangular gate 18 that is configured to exhibit rectilinear motion, FIG. 6B shows a semi-annular gate 18 that is configured to exhibit rotational motion, and FIG. 6C shows a semi-annular gate 18 that is configured to exhibit both rectilinear and rotational motion combined. While FIGS. 6A-6C show particular configurations of the gate 18 of the add-on module 12, other gate 18 configurations are contemplated and are within the scope of the present disclosure.

Figure 7A:
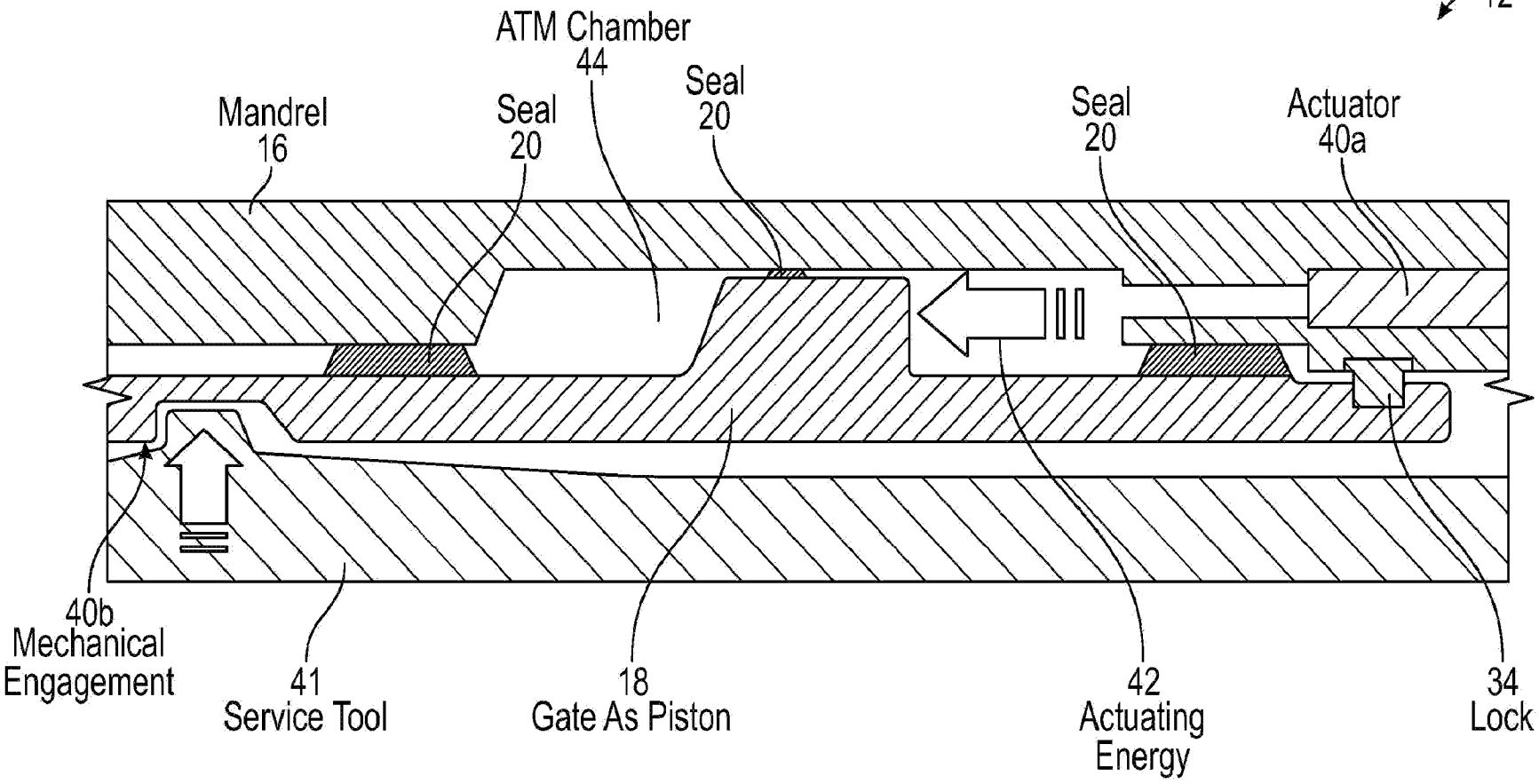
FIGS. 7A-7F show different configurations of an add-on module having two independent actuators and a plurality of locks according to one or more embodiments of the present disclosure.

Referring now to FIGS. 7A-7F, different configurations of an add-on module 12 according to one or more embodiments of the present disclosure are shown. For example, FIG. 7A shows a zoomed-in cross-sectional view of a one-sided inner gate 18 as a piston, which may be controlled by two independent actuators 40*a*, 40*b* in one or more embodiments of the present disclosure. In operation, the actuator 40*a* in the add-on module 12 releases an actuating energy 42 that collapses an atmospheric pressure chamber 44 to push the piston 18 into another, different position. Further, the actuator 40*b* in the service tool 41, which may include mechanical engagement, for example, is able to drag the piston 18 to another position. As shown, the locking mechanisms 34 are able to secure the piston 18 at the different positions, according to one or more embodiments of the present disclosure. Further, the sealing mechanisms 20 may aid the change in flow path configuration within the add-on module 12 when the piston 18 is at the different positions. According to one or more embodiments of the present disclosure, the sealing mechanisms 20 may allow pressure containment into the add-on module 12 or through the add-on module 12 from the wellbore, the annulus 25, the inside of the downhole tubular 24, between devices connected to the add-on module 12, and any combination thereof. Moreover, the sealing mechanisms 20 may be active and change forms due to controlled external stimuli, or the sealing mechanisms 20 may be passive and conform to wellbore conditions in the add-on module 12, in one or more embodiments of the present disclosure.

Figures 7B, 7C, 7D:
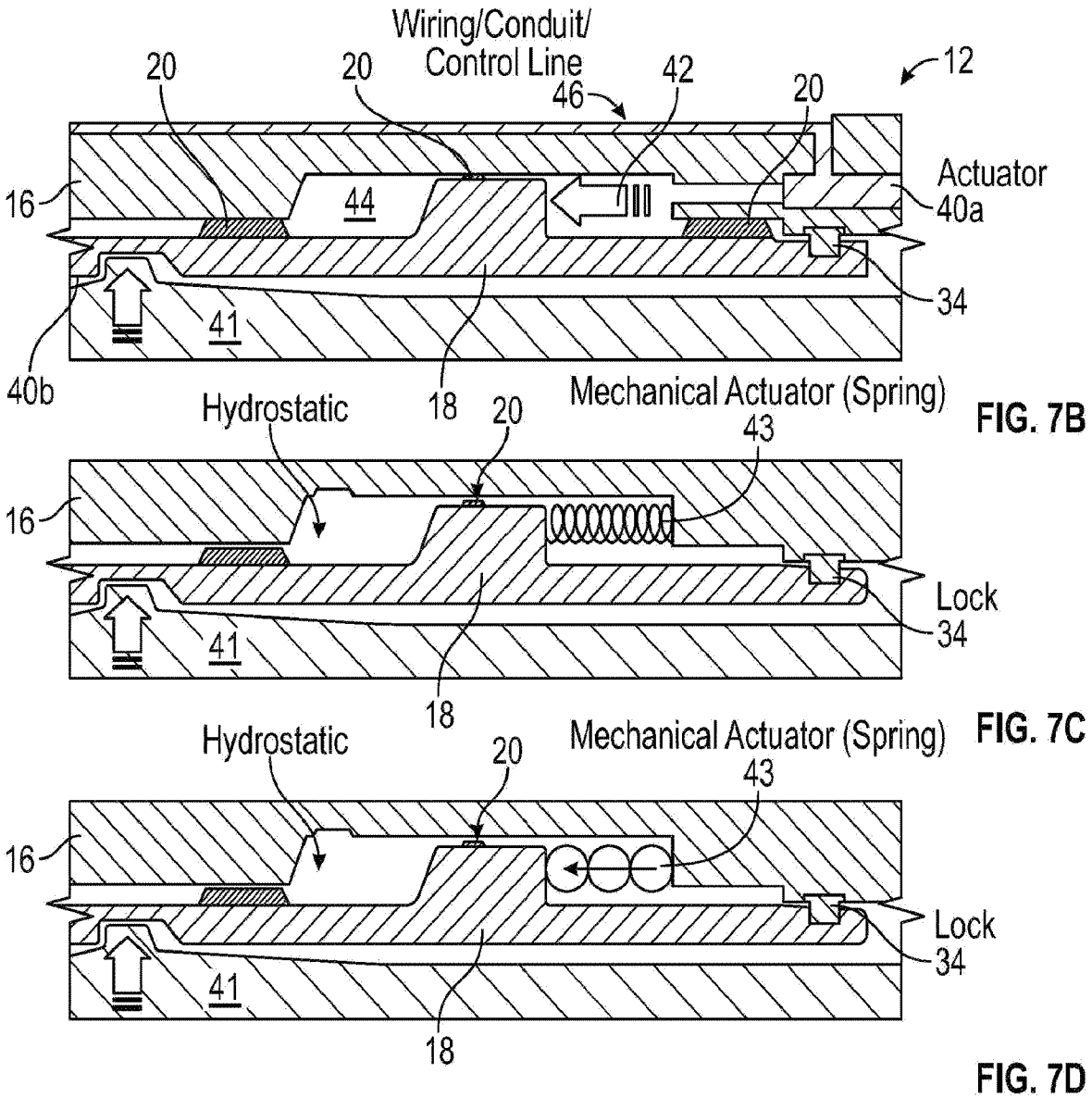

FIG. 7B, which is similar to FIG. 7A as previously described, clarifies that the actuator 40*a* within the add-on module 12 may be connected through wiring, conduit, or a control line 46, for example, to another device to facilitate actuation according to one or more embodiments of the present disclosure. In one or more embodiments, the connection transports a signal for activation, data, and any combination thereof, for example.

Referring now to FIGS. 7C and 7D, the actuating energy of the add-on module 12 according to one or more embodiments of the present disclosure may be supplied by a mechanical actuator such as a spring 43, for example. While no atmospheric chamber is shown in the embodiments of FIGS. 7C and 7D, the system can also work in the presence of one directly or indirectly actuating the mechanical components.

Figure 7E:
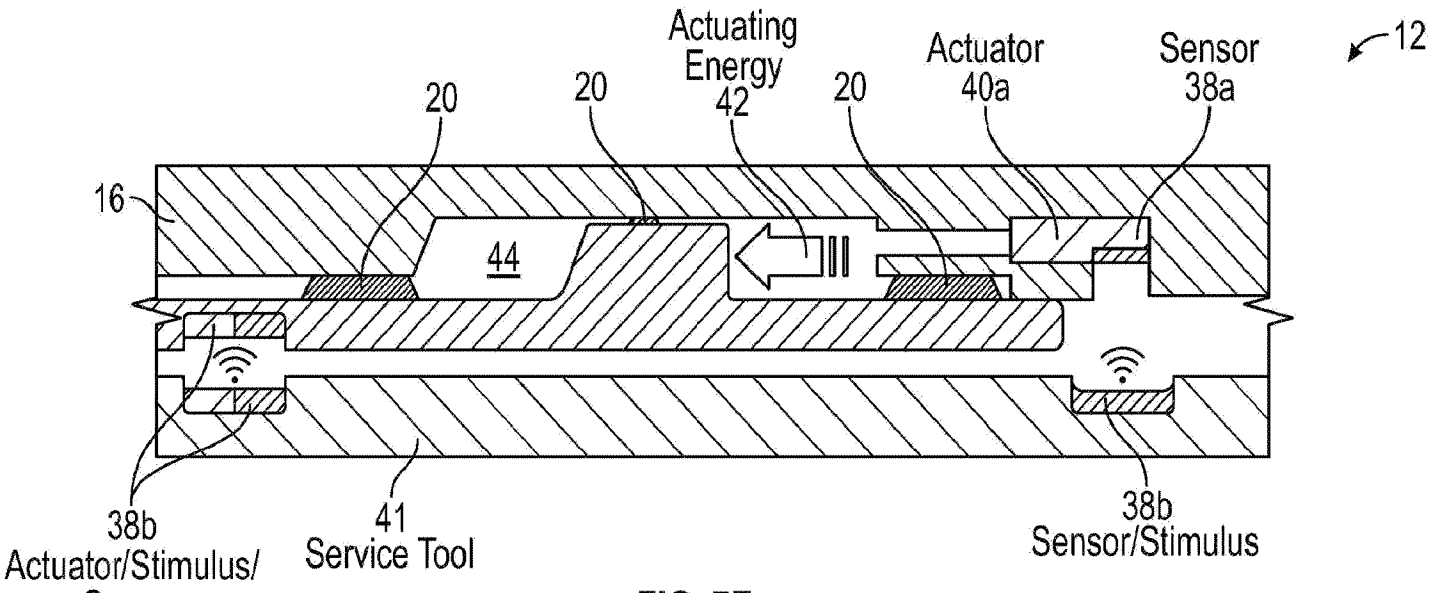
Figure 7F:
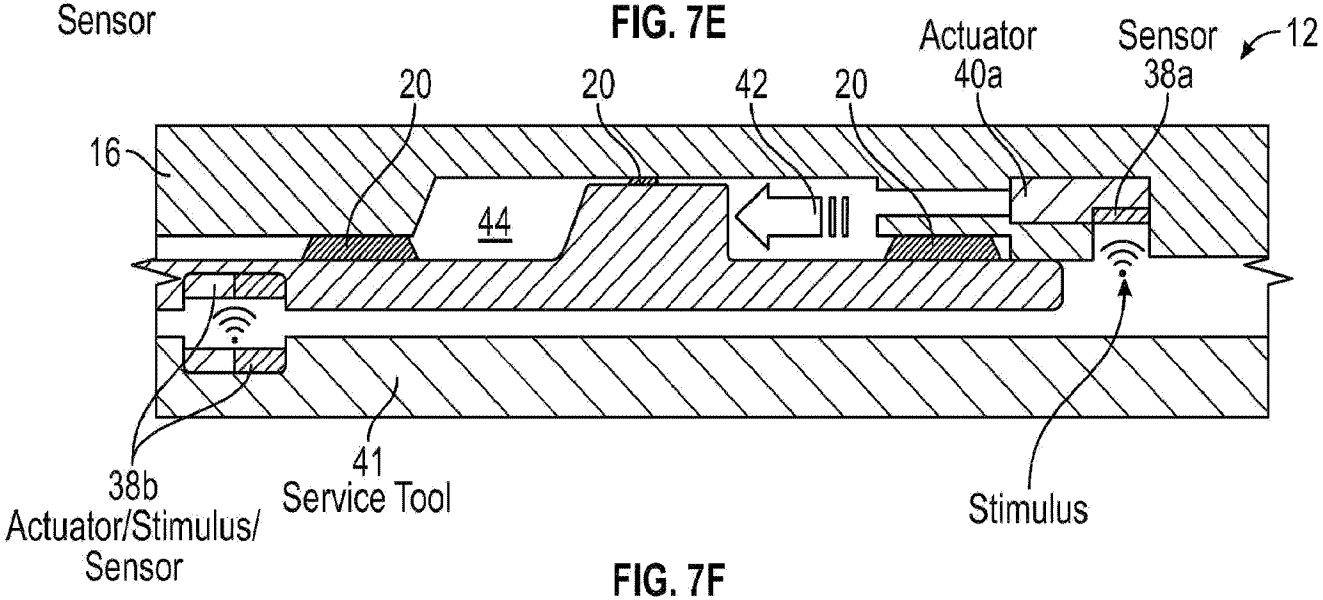

Referring now to FIGS. 7E and 7F, the actuator 40*a* of the add-on module 12 according to one or more embodiments of the present disclosure may be triggered by one or more sensors 38*b* in the service tool 41 or by the fluid and/or sensors 38*a* in the fluid in the inner diameter (ID) of the add-on module 12. According to one or more embodiments of the present disclosure, the add-on module 12 and the service tool 41 have fluid and tool status sensors 38*a*, 38*b*, as previously described with respect to the at least one monitoring mechanism 38, for example.

Referring back to FIG. 3A, for example, in a method according to one or more embodiments of the present disclosure, at least one sand control device 14 and/or other devices in the BHA may be configured to channel fluids in the annulus (formed between the device and the wellbore) through the add-on module 12, before such fluids reach any other section of the downhole tubular 24. As previously described, the add-on module 12 may be coupled in-line to at least one sand control device 14 and/or other devices in the BHA. An example of this configuration includes, but is not limited to, a sand control device 14 with a non-perforated base pipe and means for connecting the filtered flow path 28 to the add-on module 12. According to one or more embodiments of the present disclosure, the means for connecting the filtered flow path 28 to the add-on module 12 may include one or more of, threading, retaining elements, other mechanical engagement, or equivalents thereof, for example.

Sand control operations that employ the add-on module 12 according to one or more embodiments of the present disclosure include, but are not limited to, gravel packing a wellbore and the production of hydrocarbons. During a gravel packing operation according to one or more embodiments of the present disclosure, carrier fluid is drained through at least one sand control device 14, passing through the add-on module 12, and into the inside of the downhole tubular 24 for returning to the surface. As described, this flow path 28 in the add-on module 12 is designed for the gravel packing operation according to one or more embodiments of the present disclosure. During a production operation according to one or more embodiments of the present disclosure, the fluid produced from the formation is filtered by the at least one sand control device 14, passing through the add-on module 12, and into the inside of the downhole tubular 24 to be produced at the surface. According to one or more embodiments of the present disclosure, the flow path 28 for the production operation may be the same as the flow path 28 for other operations, including a gravel packing operation, for example. Moreover, in one or more embodiments of the present disclosure, at least an alternate flow path may be configured for production by actuating the at least one gate 18 of the add-on module 12, as previously described. Consequently, when hydrocarbons pass through the add-on module 12, flow may be regulated by at least one flow control device (e.g., an at least one ICD 36) and/or fluids may be monitored by the at least one monitoring mechanism 38 according to one or more embodiments of the present disclosure. In one or more embodiments of the present disclosure, further alternate paths may be configured at different stages of the production lifecycle, including new alternate flow paths, previous alternate flow path configurations used during run in hole and/or gravel packing operations, and/or isolation of the add-on module 12 from the annulus 25, from other devices (including flow from other sand control devices 14 referred to as crossflow), from the inside of the downhole tubular 24 (including flow from other producing zones referred to as crossflow), and any combination thereof.

Other sand control operations may include changing the flow path configuration of the add-on module 12 by moving the at least one gate 18, as previously described. As shown in FIGS. 7A-7F, for example, at least one actuator 40*a*, 40*b* in the BHA may interact with the at least one gate 18, moving it to a different position. In this new position, the at least one gate 18 channels the passage of fluid through a certain configuration of flow paths 28 in the add-on module 12, and/or isolates the flow paths 28 of the add-on module 12 from other sand control devices, from other devices in the BHA, from the annulus 25, from the inside of the downhole tubular 24, and any combination thereof. According to one or more embodiments of the present disclosure, the add-on module 12 may also include at least one sealing mechanism 20 in any of its components to aid in the change in flow path configuration, as previously described.

Figure 8:
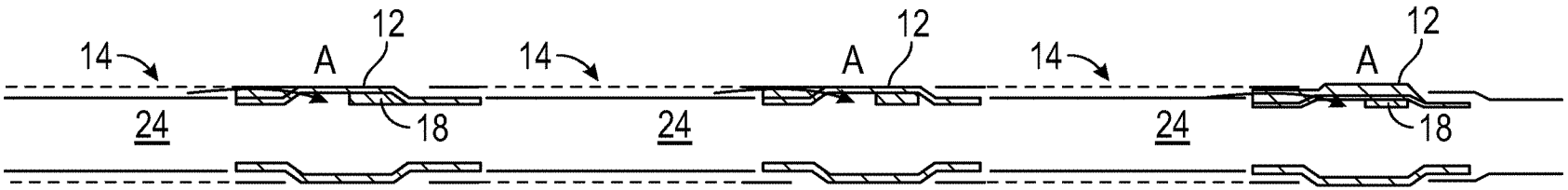
FIG. 8 shows a first configuration of a system according to one or more embodiments of the present disclosure.

In a completions system, different embodiments of the add-on module 12 may be used in the same BHA to accomplish different tasks. For example, FIG. 8 shows a first configuration of a system according to one or more embodiments of the present disclosure. As shown in FIG. 8, the system may include a plurality of sand control devices 14 each coupled in-line with an add-on module 12 according to one or more embodiments of the present disclosure. During a gravel packing operation, the add-on modules 12 within the system may allow flow from the sand control devices 14 into the inside of the downhole tubular 24. During a production operation, at least one gate 18 may be moved to expand or restrict the flow into the downhole tubular 24, or to fully isolate the add-on module 12 from the inside of the downhole tubular 24, as previously described. Moreover, an actuator 40*a*, 40*b* can selectively operate the at least one gate 18 of each add-on module 12 in the string. Advantageously, selective operation of the at least one gate 18 by the actuator 40*a*, 40*b* in this way allows for the control of flow per an individual sand control device 14, at least a group of sand control devices 14, and/or all of the sand control devices 14, in the same intervention of the well and/or in subsequent interventions of the well.

Figure 9A:
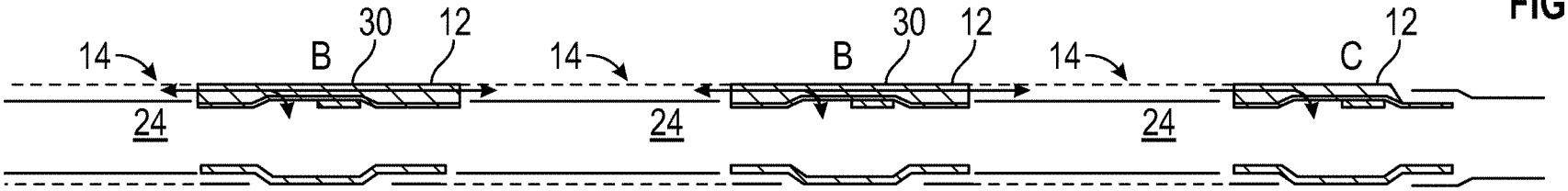
FIGS. 9A and 9B show a second configuration of a system in gravel packing and intelligent production mode, according to one or more embodiments of the present disclosure.
Figure 9B:
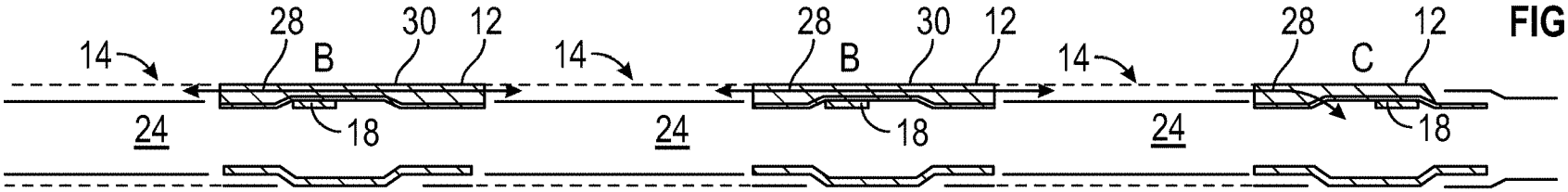

Referring now to FIGS. 9A and 9B, a second configuration of a system according to one or more embodiments of the present disclosure is shown. For example, FIG. 9A shows the second configuration of the system according to one or more embodiments of the present disclosure in a gravel packing operation, and FIG. 9B shows the second configuration of the system according to one or more embodiments of the present disclosure in a production operation. As shown in FIGS. 9A and 9B, the system according to one or more embodiments of the present disclosure may include a first set of add-on modules 12 having at least one permeable section 30 (Configuration B) for filtering fluid from the annulus 25 into the add-on module 12. As further shown in FIGS. 9A and 9B, each add-on module 12 may be coupled in-line between two sand control devices 14, as previously described. As shown in FIG. 9A, during a gravel packing operation, the add-on modules 12 may allow flow from the sand control devices 14 into the inside of the downhole tubular 24, according to one or more embodiments of the present disclosure. As shown in FIG. 9B, during a production operation, the add-on modules 12 may allow flow between sand control devices 14, and the at least one gate 18 of the add-on modules 12 may be actuated to close the flow path 28 into the inside of the downhole tubular 24.

A second set of add-on modules 12 without a permeable section (Configuration A), as shown in FIG. 8 for example, may channel the fluid from a plurality of sand control devices 14 connected by the first set of add-on modules 12 with a permeable section 30 (Configuration B) into the inside of the downhole tubular 24 during gravel packing and production operations. The at least one gate 18 in the second set of add-on modules 12 (Configuration A) may be moved during the production operation to expand or restrict the flow into the downhole tubular 24, or to fully isolate the add-on module 12 from the inside of the downhole tubular 24.

Figure 10:
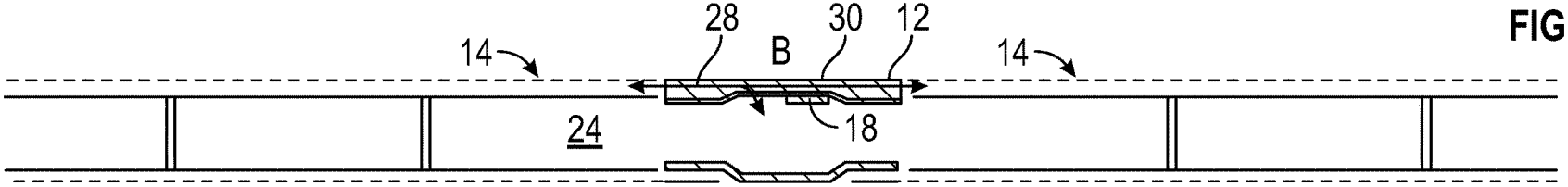
FIG. 10 shows a third configuration of a system according to one or more embodiments of the present disclosure.

Referring now to FIG. 10, a third configuration of a system according to one or more embodiments of the present disclosure is shown. As shown in FIG. 10, the third configuration of the system according to one or more embodiments of the present disclosure may include an add-on module 12 with or without at least one permeable section 30 for filtering fluid from the annulus 25 into the add-on module 12. The add-on module 12 may be coupled in-line between a plurality of sand control devices 14, as previously described. During a gravel packing operation, the add-on module 12 may allow flow from the sand control devices 14 into the inside of the downhole tubular 24 through the same flow path 28 or through alternate flow paths 28 along the life of the well. As previously described, the add-on module 12 may include at least one gate 18, which may be actuated to fully isolate the add-on module 12 from the inside of the downhole tubular 24, according to one or more embodiments of the present disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A tool comprising:

a mandrel connected to at least one sand control device of a bottom hole assembly, the mandrel comprising:

a bore; and a flow path configuration selected from at least one of the group consisting of: at least one flow path connecting the at least one sand control device to the bore; at least one flow path connecting the bore to at least two sand control devices; and at least one flow path connecting the bore to the at least one sand control device and to another device of the bottom hole assembly; and at least one gate comprising a member and an inflow control device disposed in the member, wherein the at least one gate is configured to move from an initial position into a different position to control fluid flow through the flow path configuration.

2. The tool of claim 1, wherein, in the different position, the at least one gate allows or restricts passage of fluid through the flow path configuration.

3. The tool of claim 2, wherein, in the different position, the at least one gate isolates the at least one flow path of the flow path configuration from one or more of: other sand control devices in the bottom hole assembly; other devices in the bottom hole assembly; a wellbore annulus; and an inner diameter of the tool.

4. The tool of claim 1, wherein, in the different position, the at least one gate isolates the at least one flow path of the flow path configuration from one or more of: other sand control devices in the bottom hole assembly; other devices in the bottom hole assembly; a wellbore annulus; and an inner diameter of the tool.

5. The tool of claim 1, the mandrel further comprising an outer permeable section that filters fluid from a wellbore annulus into the tool.

6. The tool of claim 1, the mandrel further comprising an inner permeable section that filters fluid from an inside of a downhole tubular connected to the bore of the mandrel and coaxial with the at least one sand control device or other device of the bottom hole assembly into the tool.

7. The tool of claim 1, further comprising at least one locking mechanism that maintains the at least one gate in at least one of the initial position and the different position.

8. The tool of claim 1, wherein the at least one gate is operable by an actuator.

9. The tool of claim 8, wherein the actuator is disposed inside the tool.

10. The tool of claim 8, wherein the actuator is outside the tool or runs through the bottom hole assembly, the actuator being disposed on or in at least one selected from the group consisting of: a service tool; a washpipe; a pipe; a wire; a conduit; fluids; and a device carried by fluids.

11. The tool of claim 8, further comprising at least one monitoring mechanism that transmits downhole information to the actuator.

12. The tool of claim 1, further comprising at least one monitoring mechanism installed in-line with at least one flow path within the mandrel.

13. The tool of claim 1, further comprising at least one monitoring mechanism, wherein the at least one monitoring mechanism is outside the tool or runs through the bottom hole assembly, the at least one monitoring mechanism being disposed on or in at least one selected from the group consisting of: a service tool; a washpipe; a pipe; a wire; a conduit; fluids; and a device carried by fluids.

14. The tool of claim 1, further comprising:

a tubular member disposed in the mandrel, wherein the at least one gate is disposed in the tubular member.

15. A method comprising:

conveying a bottom hole assembly downhole in a wellbore, the bottom hole assembly comprising:

at least one sand control device; and a tool comprising:

a mandrel connected to the at least one sand control device, the mandrel comprising:

a bore; and a flow path configuration selected from at least one of the group consisting of: at least one flow path connecting the at least one sand control device to the bore; at least one flow path connecting the bore to at least two sand control devices; and at least one flow path connecting the bore to the at least one sand control device and to another device of the bottom hole assembly; and at least one gate comprising a member and an inflow control device disposed in the member, the at least one gate moveable from an initial position to a different position;

performing a gravel packing operation through the at least one sand control device and the tool while the at least one gate is in the initial position;

after the gravel packing operation, actuating the at least one gate of the tool from the initial position into the different position to control production fluid flow; and performing a production operation through the at least one sand control device and the tool while the at least one gate is in the different position.

16. The method of claim 15, further comprising:

a tubular member disposed in the mandrel, wherein the at least one gate is disposed in the tubular member.

17. A system comprising:

a bottom hole assembly comprising:

a plurality of sand control devices;

a tool coupled to at least one of the plurality of sand control devices, the tool comprising:

a mandrel comprising:

a bore; and a flow path configuration selected from the group consisting of: at least one flow path connecting the at least one sand control device to the bore; at least one flow path connecting the bore to at least two sand control devices; and at least one flow path connecting the bore to the at least one sand control device and to another device of the bottom hole assembly;

a first gate and a second gate, the first gate and the second gate each being disposed in an initial position for a gravel packing operation, and wherein the first gate and the second gate are configured to move from the initial position into a different position for a production operation to control fluid flow through the flow path configuration; and an inflow control device disposed between the first gate and the second gate when the first gate and the second gate are each in the initial position.

18. The system of claim 17, further comprising an actuator that selectively operates the first gate and the second gate of the tool in the bottom hole assembly.

19. The system of claim 17, wherein the mandrel further comprises an outer permeable section that filters fluid from a wellbore annulus into the tool.

20. The system of claim 17, further comprising:

a tubular member disposed in the mandrel, wherein the first gate and the second gate are disposed in the tubular member.

* * * * *